US007147879B2

(12) United States Patent
Stemmler

(10) Patent No.: US 7,147,879 B2
(45) Date of Patent: Dec. 12, 2006

(54) TEA BAG PACKAGE

(76) Inventor: Joerg Stemmler, Frauenstrasse 13, Munich 80469 (DE)

( * ) Notice: Subject to any disclaimer, the term of this patent is extended or adjusted under 35 U.S.C. 154(b) by 462 days.

(21) Appl. No.: 10/258,034

(22) PCT Filed: Apr. 19, 2001

(86) PCT No.: PCT/EP01/04465

§ 371 (c)(1),
(2), (4) Date: Mar. 26, 2003

(87) PCT Pub. No.: WO01/81197

PCT Pub. Date: Nov. 1, 2001

(65) Prior Publication Data

US 2003/0164313 A1 Sep. 4, 2003

(30) Foreign Application Priority Data

Apr. 19, 2000 (DE) ..... 100 19 444

(51) Int. Cl.
*B65D 85/808* (2006.01)
*B65D 85/812* (2006.01)

(52) U.S. Cl. ..... 426/79; 426/77; 426/80

(58) Field of Classification Search ..... 426/77–84
See application file for complete search history.

(56) References Cited

U.S. PATENT DOCUMENTS 2,728,671 A 12/1955 Young et al.
2,860,989 A * 11/1958 Geisinger ..... 426/83
3,057,729 A * 10/1962 Grant ..... 426/80
3,566,573 A 3/1971 Irmscher ..... 53/14
3,597,222 A * 8/1971 Kalemba ..... 426/79
4,250,990 A * 2/1981 Casper ..... 206/0.5
4,584,101 A * 4/1986 Kataoka ..... 210/474
4,735,810 A * 4/1988 Dacal ..... 426/80
4,844,914 A * 7/1989 Bonne et al. ..... 426/79
4,875,574 A * 10/1989 Travers ..... 206/0.5

(Continued)

FOREIGN PATENT DOCUMENTS

DE 38 26 911 A1 2/1990

(Continued)

OTHER PUBLICATIONS

International Search Report in PCT/EP01/04465 dated Aug. 29, 2001.

(Continued)

*Primary Examiner*—Steve Weinstein
(74) *Attorney, Agent, or Firm*—Marshall, Gerstein & Borun LLP

(57) ABSTRACT

A tea bag package including a filter container for a product such as tee, comprising an envelope to be opened, said envelope enclosing the filter container, and a pull element which is associated with the filter container and can be pulled through an opening in the envelope. The envelope comprises an external cover sheet fold, whose overlapping sheet portions are releasably connected to each other, thus to hold the envelope in a closed condition. The cover sheet fold has an opening at its back. The pull element is formed by a pull element fold and comprises a back which can be grasped as a grip member in the opening of the cover element fold. The pull element fold or its sheet portions basically shield the opening in a closed condition of the envelope. The filter container is designed to be foldable in its center at its longitudinal side, namely with the edge ends being contiguous with the pull element fold and being spaced apart from the free edge ends of the pull element fold.

6 Claims, 2 Drawing Sheets

U.S. PATENT DOCUMENTS

| | | | | | |
|---|---|---|---|---|---|
| 5,059,325 | A | * | 10/1991 | Iida | 210/474 |
| 5,132,124 | A | * | 7/1992 | Tamaki et al. | 426/82 |
| 5,318,786 | A | | 6/1994 | Clarkson | 426/79 |
| 5,605,710 | A | * | 2/1997 | Pridonoff et al. | 426/86 |
| 5,620,724 | A | * | 4/1997 | Adler | 426/77 |
| 5,842,408 | A | * | 12/1998 | Hatta | 99/323 |
| 6,733,804 | B1 | * | 5/2004 | Lohrey et al. | 426/79 |

FOREIGN PATENT DOCUMENTS

| | | | |
|---|---|---|---|
| DE | 296 10 310 U1 | | 11/1996 |
| DE | 29700772 | * | 6/1997 |
| JP | 4-210010 | * | 7/1992 |
| JP | 8-10170 | * | 1/1996 |
| JP | 9-51851 | * | 2/1997 |
| JP | 10-216017 | * | 8/1998 |
| JP | 11-113750 | * | 4/1999 |
| JP | 11-113751 | * | 4/1999 |
| WO | WO 94/15837 | | 7/1994 |
| WO | WO-98/36991 | * | 8/1998 |

OTHER PUBLICATIONS

International Preliminary Examination Report in PCT/EP01/04465 dated Jan. 19, 2002.

* cited by examiner

TEA BAG PACKAGE

The invention relates to a tea bag package.

It is generally known to provide tea bags with a folded cover sheet serving for closing the unused tea bag and moreover fulfilling several practical purposes for suspending the tea bag for the purpose of brewing the tea as well as for protecting the fingers when pulling out the tea bag after brewing (see, e.g., U.S. Pat. No. 2,728,671). In tea bags with a pull thread, it is also known to provide the pull thread in an opening in an upper portion of the folded cover sheet (DE-3826911-A1, WO 94/15837-A1, DE 29610310-U1). Moreover, it is known from reference DE 38 26 911 A1 to provide for the envelope of the tea bag a folded sheet which is designed as an auxiliary means for wringing, wherein the sheet portions of the folded sheet are releasably connected to each other around their free edges. What is disadvantageous in the known tea bag package is that the pull thread and possibly also the auxiliary means for wringing can relatively easily drop into the brewing vessel during the brewing of tea, so that the tea bag can be removed from the brewing vessel only with difficulty.

Accordingly, it is an object of the invention to provide a package which enables safe suspension of tea filter bags in a cup when tea is brewed with hot water.

It is an advantage of the invention that the package forms a flat rectangular cushion-like package in its closed condition without any protruding parts. A further advantage of the invention consists in that it forms a package with an integrated mechanism which enables efficient extraction of the tea bag after brewing by withdrawing a pull element provided at the outside of the package, which can be grasped by the fingers. In the package designed in accordance with the invention, a folded sheet is used for the pull element provided at the package. Furthermore, an elongated foldable tea bag is used, at the longitudinal side of which there is, for example, a swivel joint is in its centre. The folded cover sheet and the folded pull element are approximately identical in length and are attached to each other at their ends to form an edge. The tea bag is not quite as long as the folded pull element, and its ends are attached to the folded pull element at a certain distance from the ends of the folded cover sheet. The back portion of the folded pull element is accessible in one back opening of the folded cover sheet, wherein the width of the folded pull element conforms to the opening length of the opening in the folded cover sheet along the back.

The opening of the folded cover sheet has a width which enables that the folded pull element to be grasped in the opening. Both the folded cover sheet and the folded pull element have their upper portions directed opposite each other, so that the pull element fold basically replaces the material which has been removed from the upper portion of the cover sheet fold due to the opening when the package is closed.

When the package is held and opened with the upper portions of the folded cover sheet at the top, the median portion of the tea bag drops below the level of the attached tea bag ends. The ends of the folded pull element outside the connection points of the tea bag are supported by the edge ends of the cover sheet and reinforced and thus form support ledges which can be placed on two opposite sides of a tea cup. During brewing, the upper portion of the folded pull element is directed against the upper portion of the folded cover sheet due to its intrinsic stiffness. After brewing, the user can grasp the upper portion of the folded pull element and pull it back or out through the opening of the folded cover sheet, whereby the tea bag is pulled into the package and pulled out of the tea cup, while the user can press his finger against the folded cover sheet in the vicinity of its upper portion. The tea bag that has been pulled out has meanwhile been pulled into the package, so that the package can be placed on unprotected surfaces without difficulty and without the risk of drops falling out of the package.

The invention will be explained in more detail in the following with the aid of exemplified embodiments represented in the drawing.

Figure 1:
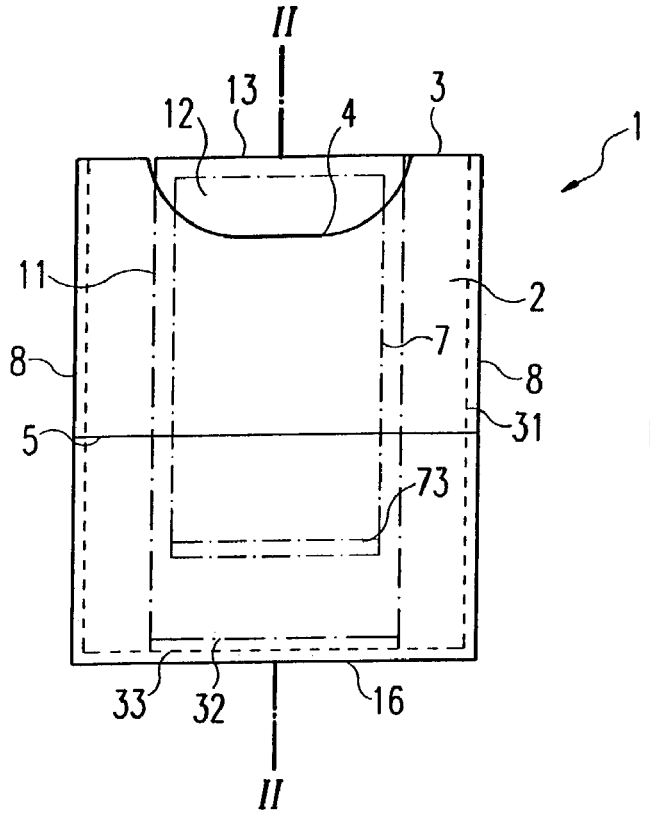
FIG. 1 is a schematic side view of a package according to the invention.

FIG. 1 shows a folded cover sheet 1 comprising two identical sheet portions 2, which are connected to each other via an upper portion 3. The folded cover sheet 1 is closed at the peripheral side around the free edges 8 of the sheet portions 2 with a weak joint, for example with a glue joint 31. In the cover sheet fold 1, there is a folded pull element 11 with two identical sheet portions 12, which are connected to each other via a upper portion 13. The folded cover sheet 1 has an opening 4 at its longitudinal side in the middle of the upper portion 3. The length of the opening 4 along the upper portion 3 conforms to the length of the upper portion 13 of the folded pull element 11, so that the folded pull element 11 can be pulled upwards through the opening 4. The opening 4 has a width which enables the upper portion 13 of the folded pull element 11 to be grasped by the fingers. Approximately at half of the length of the sheet portions 2 of folded element 1, there is a set break line 5 which is preferably formed by bending of impressing and which extends in parallel to the upper portion 3.

A filter container 7 is attached in the folded pull element 11. The filter container 7 contains two substantially similar rectangular flat bags 71, which are connected to each other via a common edge 72. When the package is closed, the common edge 72 is placed in the vicinity of the upper portions 3 and 13, while the edges 73 of the bags 71, which extend in parallel to the common edge 72, are attached to the sheet portions 12 of the folded pull element 11, namely at a certain distance from their edge ends 15, which are connected to the edge ends 16 of the sheet portions 2 of folded sheet 1. When the package is closed, the filter container 7 thus has the shape of a fold whose upper portion is in the vicinity of the upper portions 3 and 13, while the bags 71 are positioned flat along the inner side of the sheet portions 12 or 2.

The width of the container 7 is basically identical with the width of the folded pull element 11. It can be derived from FIG. 2 that the common edge 72 between the bags 71 forms a swivel joint for the bags 71 and that the attachments of the edges 73 to the sheet portions 12 also form swivel joints for the bags 71.

Figure 2:
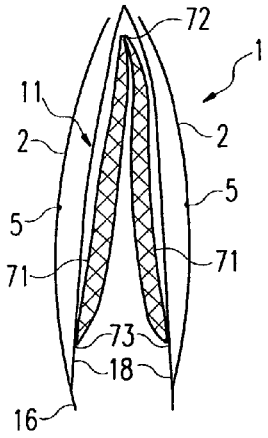
FIG. 2 shows a sectional view cut along line II—II in FIG. 1.

In order to open the closed flat package according to FIG. 2, an axial pressure force can be exerted between the upper portions 3 or 13 and the averting edges 16, whereby the weak joint of glue joint 31 breaks up at least along the sheet portions 2 resulting in the sheet portions 2 being bent outwards, especially in the area of the set break lines 5; consequently the joint 33 between the sheet portions 2 can also be opened quite easily by tearing up at their edge 16 extending in parallel to the upper portions 3, 13. The joints 31 and 33 can be adhesive joints or impressed joints, but can also be replaced by other fastening means, such as clips, which hold together at least the edges 15 and 16. Instead of the joint 33 envisaged for holding together the sheet portions 2, it is also possible to provide a joint between the sheet portions 12 at the edge 15.

Figure 3:
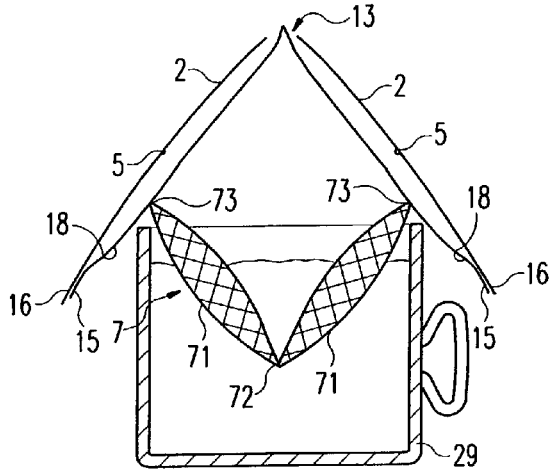
FIG. 3 is a schematic view of the open package in a condition placed on a tea cup for brewing tea.

After opening the joints 31 and 33 of the package, the sheet folds 1 and 11 can be opened, whereby the bags 71 can assume a position relative to the folded sheets 1 and 11 or their sheet portions 2 and 12, as illustrated in FIG. 3. The joint 32 between the edge ends 15 and 16 of the sheet portions 2 and 12 is correspondingly strong and can be formed, for example, by means of clips. Since the filter container 7 is usually flexible, the common part of the edge 72 will drop to the configuration illustrated in FIG. 3 as a result of gravitation, as soon as the folded sheets 1 and 11 are opened and if the upper portions 3 and/or 13 are placed vertically at the top.

It can be derived from FIG. 3 that a support angle 18 open to the bottom is formed between the attachment joint of the edge 73 of the bags 71 towards the folded pull element 11 and the edges 15 of the folded pull element 11. Thereby the open package can be supported on two opposite borders of a tea cup 29 or the like, while the filter container 7 is simultaneously immersed into the liquid in the tea cup and the folded sheets 1 and 11 remain dry at the same time.

Figure 4:
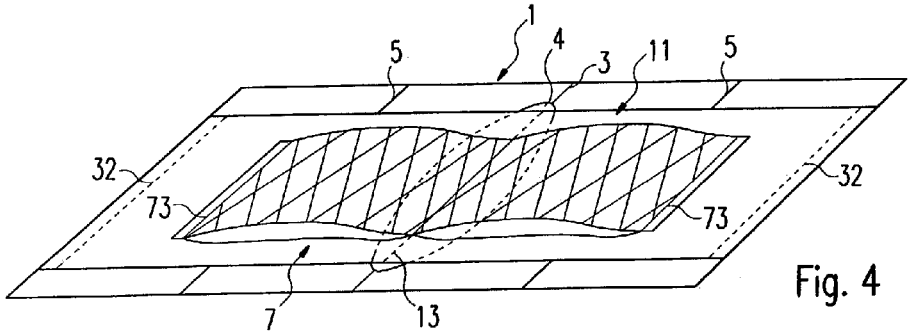
FIG. 4 is a perspective view of the package in an open flat condition.

FIG. 4 is a schematic view of the package after it has been opened completely and brought into a flat condition, wherein the sheet portions 2 and/or 12 of the folded sheets 1 and 11 are unfolded by 180°, i.e. put in a flat position. As illustrated, the filter container 7 is slightly smaller in width than the folded pull element 11. Furthermore the set break line 5 is approximately at half the length of the appertaining sheet portions 2 of the folded cover sheet 1. In addition, it can be seen that the edge 72 as well as the upper portions 3 and 13 basically coincide. Moreover, it can be seen that the bags 71 abut flatly on the sheet portions 12, which on their part abut flatly on the sheet portions 2.

Figure 5:
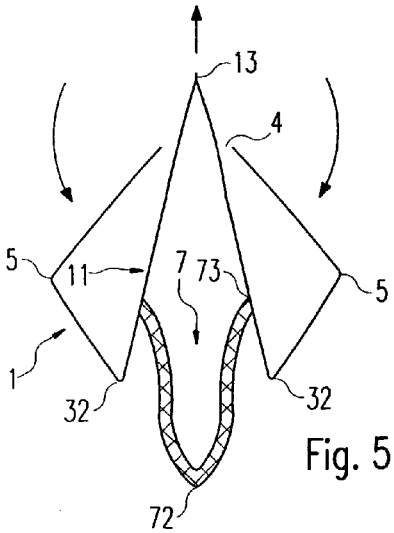
FIG. 5 and FIG. 6 show two stages, namely when the tea bag is removed and when the filter container is pulled into the package.
Figure 6:
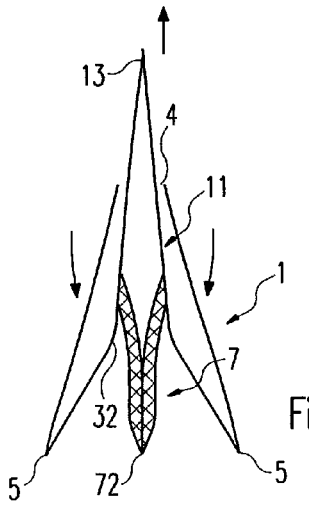

FIG. 5 shows how the tea bag or rather its filter container 7 can be drained after the tea has been brewed (see e.g., FIG. 3), namely by grasping the pull element fold 11 in the area of its upper portion 13, which is accessible in the opening 4 of the folded cover sheet 1, and by pulling upper portion the folded pull element 11 through the opening 4, while the outside of the folded cover sheet 1 is supported with the other hand. As result thereof, the sections of the sheet portions 2 being closest to the edge 16 are turned down at the edge 16, whereby the sheet portions 12 of the folded pull element 11 are prolonged, as a result of which the thus prolonged folded pull element 11 forms a protection from contact as against the two-layer filter container 7. At the end of the procedure of withdrawal (FIG. 6), the fingers can be pressed against the portions of the folded cover sheet 2 contiguous with the upper portion 3, before the liquid is squeezed out of the filter bag 7.

Figure 7:
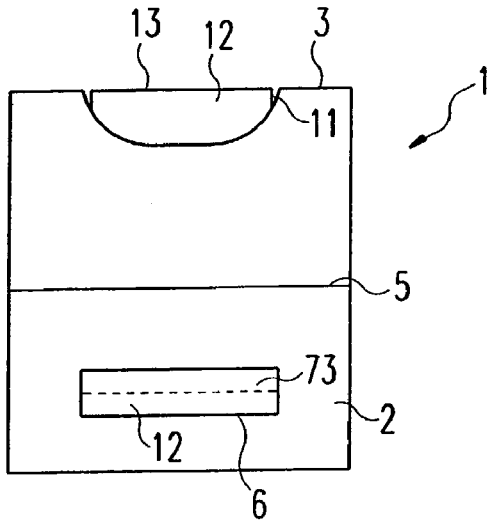
FIG. 7 is a variant in which the filter container is clamped to the inside pull element fold.

What can be derived from FIG. 7 is that the joint 73 can also be formed by clips for reasons of simplicity. Clip stamp and clip die can be applied at the top or the bottom of the object according to FIG. 2, without such a clip incorporating the sheet portions 2 if the sheet portions 2 have their openings 6 in the clip positions. The width of the opening is respectively smaller than the width of the sheet portions 12.

It is to be noted that the term "tea" is supposed to cover all products which are suited for giving flavour to a liquid.

The invention claimed is:

1. A package comprising a filter container containing a product capable of flavoring a liquid when contacted with said liquid, an envelope, and a folded pull element; said envelope enclosing said filter container and said folded pull element; said envelope comprising a folded cover sheet, folded along a cover sheet fold line to form overlapping cover sheet portions which are releasably connected to each other to hold the envelope in a closed condition and enclose both the folded pull element and the filter container; said folded cover sheet further including an opening located in the region of the cover sheet fold line; said folded pull element comprising a second folded sheet folded along a pull element fold line to form pull element sheet portions, wherein the pull element fold line is arranged in the folded cover sheet adjacent the cover sheet fold line; said folded cover sheet and said folded pull element both having opposing free edges away from their respective fold lines with said folded pull element being attached to said folded cover sheet adjacent the respective opposing free edges; said opening in said folded cover sheet being sized to allow the pull element to close the opening when the envelope is in the closed condition, but also sized to allow the pull element in the region of the pull element fold line to be used as a grip member and to be grasped and pulled through the opening; said filter container comprising two substantially similar rectangular flat bags connected to each other by a common fold edge, wherein said common fold edge is placed in the vicinity of the grip member which in turn is in the vicinity of the cover sheet fold line when said envelope is in a closed condition; the opposing end edges of the bags, spaced from and extending parallel to said common fold edge, being attached to said respective pull element sheet portions at a distance from the respective free edges of said folded pull element and the pull element fold line; wherein upon releasing the connection between the overlapping cover sheet portions, the envelope is opened and upon holding the envelope with both the cover sheet fold line and pull element fold line and the common fold edge of the bags at the top of the envelope, and moving the cover sheet portions away from each other, the common fold edge of the bags drops below the level of the opposing end edges of the bags and the bottom of the envelope, allowing the bags to be positioned in a cup of liquid to flavor the liquid while being supported in the liquid by the remainder of the package being supported on the rim of the cup, and such that upon finishing the flavoring process, the grip member of the pull element can be grasped in the opening of the folded cover sheet and a portion of the pull element can be pulled through the opening, causing the bags to be pulled back into the folded cover sheet.

2. A package as claimed in claim 1, wherein each one of the sheet portions of the folded cover sheet is provided with an approximately median set break line extending in parallel to the cover sheet fold line.

3. The package of claim 1 where said product in said filter container is tea.

4. The package of claim 1 wherein said filter container consists of a folded sheet having said overlapping sheet portions.

5. The package of claim 4 wherein the filter container consists of said two substantially similar rectangular flat bags.

6. The package of claim 1 wherein the filter container consists of said two substantially similar rectangular flat bags.

* * * * *